US008579122B2

(12) United States Patent
Dantus et al.

(10) Patent No.: US 8,579,122 B2
(45) Date of Patent: Nov. 12, 2013

(54) MODULAR SYSTEM FOR DISPLAY

(75) Inventors: Daniel Dantus, Naucalpan (MX); David Canseco, Naucalpan (MX); Victor Finkelstein, Naucalpan (MX)

(73) Assignee: Dimension Espacio, S.A. DE C.V., Naucalpan (MX)

( * ) Notice: Subject to any disclaimer, the term of this patent is extended or adjusted under 35 U.S.C. 154(b) by 84 days.

(21) Appl. No.: 13/074,544

(22) Filed: Mar. 29, 2011

(65) Prior Publication Data

US 2012/0248948 A1 Oct. 4, 2012

(51) Int. Cl.
*A47F 7/00* (2006.01)

(52) U.S. Cl.
USPC ..... 211/49.1; 206/564

(58) Field of Classification Search
USPC ..... 211/40, 41, 12, 49.1, 189, 134, 175, 211/13.1; 312/107, 108, 111, 234; 403/299, 403/296, 307; 40/657; 206/566, 465, 564, 206/740, 759; 248/121, 146; 220/4.28, 220/4.29, 4.31, 4.32, 4.33, 4.34, 507, 23.4, 220/23.6, 23.2
See application file for complete search history.

(56) References Cited

U.S. PATENT DOCUMENTS

| | | | | |
|---|---|---|---|---|
| 2,316,892 | A | 4/1943 | Saul, Jr. | |
| 2,679,414 | A * | 5/1954 | Hornschuch | 403/307 |
| 2,824,395 | A | 2/1958 | Decker et al. | |
| 3,113,392 | A | 12/1963 | Downing | |
| 3,195,770 | A * | 7/1965 | Robertson | 220/23.6 |
| 3,310,218 | A * | 3/1967 | Reifers et al. | 206/521.1 |
| 3,371,439 | A * | 3/1968 | Smith et al. | 40/735 |
| 3,390,897 | A * | 7/1968 | Moore | 285/33 |
| 3,822,781 | A * | 7/1974 | Braginetz | 206/776 |
| 3,825,800 | A * | 7/1974 | Warman et al. | 361/837 |
| 4,086,858 | A | 5/1978 | Howitt | |
| 4,319,688 | A | 3/1982 | Wahl | |
| 4,328,254 | A * | 5/1982 | Waldburger | 426/393 |
| 4,428,136 | A | 1/1984 | Franklin | |
| 4,432,456 | A * | 2/1984 | Ovadia et al. | 206/566 |
| 4,799,588 | A * | 1/1989 | Trisl | 206/301 |
| 4,884,420 | A * | 12/1989 | Finkel et al. | 70/58 |
| 4,949,483 | A * | 8/1990 | Dobson et al. | 40/740 |
| 5,000,329 | A | 3/1991 | Luberto | |
| 5,078,270 | A * | 1/1992 | Campbell | 206/308.1 |
| 5,249,683 | A * | 10/1993 | Baucom | 206/462 |
| 5,511,653 | A * | 4/1996 | Ovadia | 206/6.1 |
| 5,685,626 | A * | 11/1997 | Inaba | 353/120 |
| 5,746,319 | A * | 5/1998 | Murphy | 206/725 |
| 5,746,555 | A * | 5/1998 | McEvoy | 411/14 |
| 5,769,244 | A * | 6/1998 | Wyatt | 211/40 |
| 5,845,778 | A * | 12/1998 | Hickey, Jr. | 206/459.5 |
| 6,000,535 | A * | 12/1999 | Berk et al. | 206/63.5 |
| 6,010,015 | A * | 1/2000 | Lin | 211/40 |
| 6,230,896 | B1 * | 5/2001 | Lambert | 206/722 |

(Continued)

*Primary Examiner* — Darnell Jayne
*Assistant Examiner* — Hiwot Tefera
(74) *Attorney, Agent, or Firm* — Roylance, Abrams, Berdo & Goodman, L.L.P.

(57) ABSTRACT

A versatile modular display, with a compound module with a back lid; a frame which is assembled to the back lid, the frame consisting of an upper side, a lower side, lateral sides and a lid; a section with cavities which can be assembled onto the frame, the section including a front wall with a back face, a front face being in contact with the walls substantially perpendicular to a groove; optionally, a connector which can be assembled to the frame; and an interchangeable mask including a back wall and a brace holder to be able to support goods.

18 Claims, 15 Drawing Sheets

(56) References Cited

U.S. PATENT DOCUMENTS

| | | | | |
|---|---|---|---|---|
| 6,328,499 | B1 * | 12/2001 | Reding et al. | 403/299 |
| 6,357,608 | B1 * | 3/2002 | Timm | 211/90.01 |
| 6,378,710 | B1 | 4/2002 | Grueneberg | |
| 6,379,076 | B1 * | 4/2002 | Reinhold et al. | 403/348 |
| 6,929,133 | B1 | 8/2005 | Knapp, III et al. | |
| 6,939,075 | B2 * | 9/2005 | Walz | 403/231 |
| 6,942,110 | B2 | 9/2005 | Martins | |
| 6,964,408 | B1 * | 11/2005 | Scalfari | 254/234 |
| 7,252,200 | B1 | 8/2007 | Hester | |
| 7,386,960 | B2 * | 6/2008 | Molteni | 52/238.1 |
| 2004/0000504 | A1 * | 1/2004 | Wang | 206/725 |
| 2005/0098510 | A1 * | 5/2005 | Lom et al. | 211/13.1 |
| 2007/0257040 | A1 * | 11/2007 | Price et al. | 220/507 |
| 2008/0078733 | A1 * | 4/2008 | Nearman et al. | 211/189 |
| 2008/0156675 | A1 * | 7/2008 | Sandow | 206/232 |
| 2009/0302188 | A1 * | 12/2009 | Lewis | 248/548 |

* cited by examiner

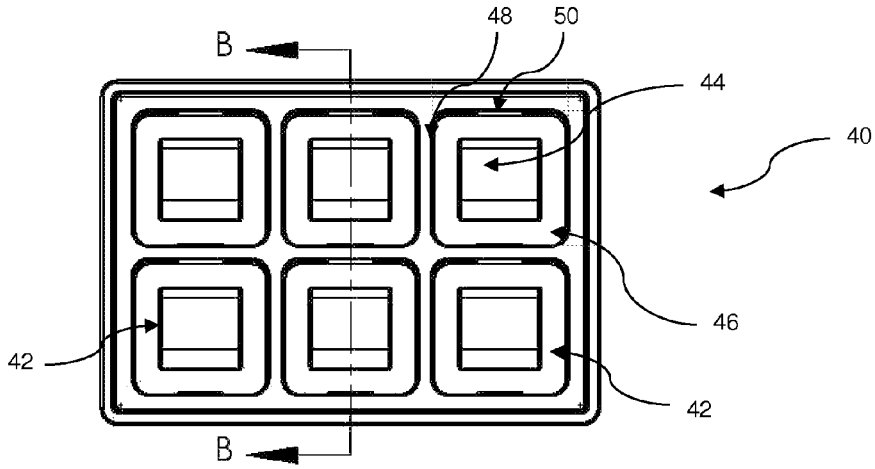
Fig. 6
SECCIÓN B-B
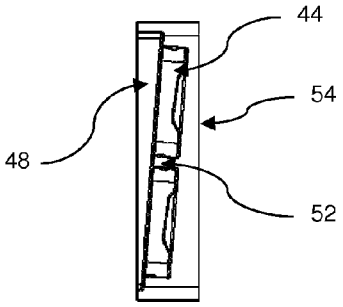
Fig. 6a
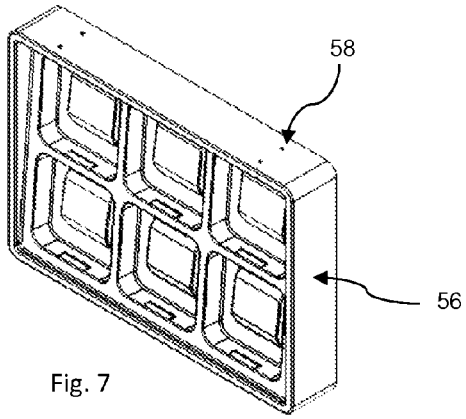
Fig. 7
Fig. 8
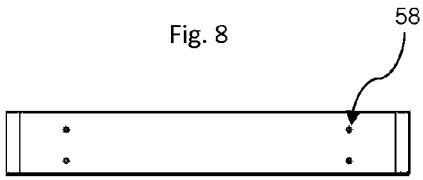

MODULAR SYSTEM FOR DISPLAY

FIELD OF INVENTION

The present invention lies in the field of modular display systems for products and more specifically, in the versatile modular display systems capable of supporting products for points of sale.

BACKGROUND OF THE INVENTION

There are an ample variety of systems in existence for the displaying of goods in the point of sales field. Many of these systems are used to display small goods or products. These varied systems employ varied means of support, such as hooks, trays and similar materials. Some of the displays can be self-supported; while others are mounted on a support structure such as can be gondola display shelving. Common gondola configurations have as characteristic long rows of shelves which face lines on any face of the gondola. On the ends of the gondola additional shelving or other showcasing areas are placed. The display systems which are self-supported comprise, among other characteristics a base which is fixed unto the display system, to be able to support the display. It is difficult to find in the art a display with the sufficient versatility to be able to be interchanged between a gondola assembly and a self-supported assembly.

A number of such displays, whether they be gondolas or the self-supported variety have been proposed in the art. Examples of this can be found in U.S. Pat. Nos. 7,252,200; 6,942,110; 6,929,133; 6,378,710; 5,000,329; 4,428,136; 4,319,688; 4,086,858; 3,113,392; 2,824,395 and 2,316,892.

BRIEF DESCRIPTION OF THE INVENTION

The present invention is directed to a modular display system for points of sale. The system is formed by at least one compound module, which in a general way, is comprised of one lid, one frame and a section with a plurality of cavities. The lid and the section with the cavities can preferably be thermoformed. The lid, the frame and the section with cavities are assembled among themselves to form the compound module.

The lid is a back section generally with a smooth and uniform surface and preferably with at least one means of connection per each corner of the lid's present. The frame, whose exterior form or silhouette shape, is essentially the same as that of the lid's, and same which has fastening means similar to those of the lid, is capable of receiving and connecting to the lid by means of connection shared between both parts. The frame, same which is found open in at least one of its faces and whose interior is substantially hollow, has at least one board which divides the frame into different sections, wherein the board runs from a first side of the frame to a second side which is opposite to the first side. The board is substantially lesser in length than the width of the first and second sides of the frame.

On the other hand, the section with cavities has a plurality of the same, specifically at least one, preferably anywhere between four to sixteen cavities; however, there can be more than sixteen cavities present, depending on the specific needs of the display assembly. The section with cavities can narrow gradually on its inner part, in such a way that the width of the inner upper part of the section with cavities is greater and the width of the lower inner part of the section with cavities is lesser. The back part of the border of the section with cavities is capable of embracing the border of the frame, by means of the face of the frame which is open. Each cavity in the section with cavities is essentially composed of a flat board on which is an interchangeable mask is seated which contains the goods to be displayed, a groove surrounding the flat board and at least one notch, and more preferably one notch per each one of the corners of the cavity, wherein the notch is capable of receiving, fastening and securing the interchangeable mask at a determined position until the interchangeable mask needs to be exchanged. The interchangeable mask, by means of the notch, is capable of being received by the cavity. It is especially preferred that the interchangeable masks be made of styrene or a derivative of the same, to be able to take advantage of the elastic memory of such plastic and to allow for the exchange of interchangeable masks. The flat board of the cavity exerts pressure towards the outside unto the interchangeable masks, in such a way that the interchangeable mask be securely fixed congruently to the display.

At least two connectors are assembled on the module, wherein the connectors allow for the connection between the module and a base, a first module and a second module or even the module and a crest. The connector comprises a principal body. In turn, the connectors are formed by at least one pair of threaded cylinders, wherein each threaded cylinder has an intermediate with a stair-step, so that the cylinder has a first section and a second section, wherein the first section is inserted within the principal body of the connector, the intermediate rests on a groove of the principal body of the connector and the second section stands out congruent to the connector, wherein on the second section an insert with an inner coil is threaded. The insert is gradually narrowed, in such a way that at least one part of the insert rests on the intermediate and another part of the insert is wider than the groove of the connector. The insert can have, along the length of its body, flanges to fasten the insert unto the groove congruent to the second section of the threaded cylinder. Over the main body of the connector, there is a first opening for the first section of the threaded cylinder, wherein the first opening is generally collinear to the groove of the principal body of the connector. Additionally, a second opening is provided in a position generally perpendicular to that of the first opening and connected to the first opening, through which a connection which could be threaded, such as can be a screw (or a fastener) or a pressing clip is capable of contacting the first section of the threaded cylinder and securing in this way, the cylinder to the main body of the connector.

The module formed by the lid, the frame and the section with cavities, has on at least two of its collinear borders, a pair of openings through which, the at least two connectors are assembled. Each connector is assembled on each opening of the border. On a border opposite to wherein the pair of openings are set, unto which the two connectors are assembled, at least one pair of reinforcements are placed, same which are assembled unto the module by means of openings on the opposite border of the module and by means of a pair of threaded cylinders with an intermediate stair-step, such as was previously described. The second section of these threaded cylinders, that is, the section which is not inserted into the reinforcement and which is remains free, can be inserted into the connector of another module, on the base connector or even directly in some openings on the base. Alternatively, the reinforcements can be ignored if it is directly connected unto the base, and if the base has a connection module, such as will be shown in an embodiment of the invention.

Thus, with this arrangement composed of modules, one can have a display which is sufficiently versatile to be able to be exchanged between gondola style displays or those which can be self-supported. Additionally, with this arrangement composed of modules, one can create a display which fills the entire gondola on one specific face, or only merely form a specific space of the gondola.

Thus an objective of the present invention is to provide a versatile modular display, with ease of assembly and disassembly, capable of being alternated from being a gondola type display to one which is self-supported or backed up to a wall, thus forming a versatile modular display system.

Another objective of the present invention is to provide a system or assembly of modular displays, wherein the modules have the capability of being assembled in different ways depending on the specific requirements of the shelving display, in addition to lending itself for the changing of products on the interchangeable masks in a quick manner and without extra fastening elements.

Yet another objective of the present invention is a versatile modular display, which comprises at least one first compound module which comprises a back lid, wherein the back lid has at least one orifice; a frame which can be assembled to a back lid, the frame being formed by an upper side, a lower side, two lateral sides and one lid, wherein the upper and lower sides have at least one orifice, wherein the lid has at least one orifice collinear with the at least one orifice of said back lid; and one section with at least one cavity, the cavity being formed by a raised flat surface and groove which surrounds said raised flat surface, the groove being delineated by the raised flat surface and by the substantially perpendicular walls of said groove, additionally, the section additionally comprises a front wall with a back face, the front wall being in contact with the walls substantially perpendicular to said groove, the front wall being delineated, partly by at least one wall substantially perpendicular, wherein the back face of the front wall is substantially hollow, so that said section has the capability of being assembled through the back face with said frame, wherein an upper and lower sides of the section have at least one orifice collinear with at least one orifice of the lower and upper sides of the frame, and wherein over the at least two walls substantially perpendicular to said groove, a notch is formed; at least one connector per each module present with the capability of being assembled unto the collinear orifices to the lower and upper sides of said section and said frame, wherein the connector comprises a main body with a lower surface, an upper surface and at least one side surface, the upper surface has an orifice through which a first means of connection is inserted, the connector additionally comprises an insert which surrounds, at least partially, the first means of connection, the at least one lateral surface has an opening connected to the orifice of the upper surface, and wherein a second means of connection is inserted through the opening of said lateral surface to fasten the first means of connection; and an interchangeable mask fastens the section with cavities by means of notches, the interchangeable mask comprises a back wall and at least one brace holder capable of supporting the goods to be displayed, wherein the support is fastened to the back wall of the interchangeable mask.

BRIEF DESCRIPTION OF THE DRAWINGS

These and other objects shall become evident when they are taken into account along with the following description and correlated to the drawings which are detailed as follows:

FIG. 6 is a front view of the section with the plurality of cavities;

Figure 9:
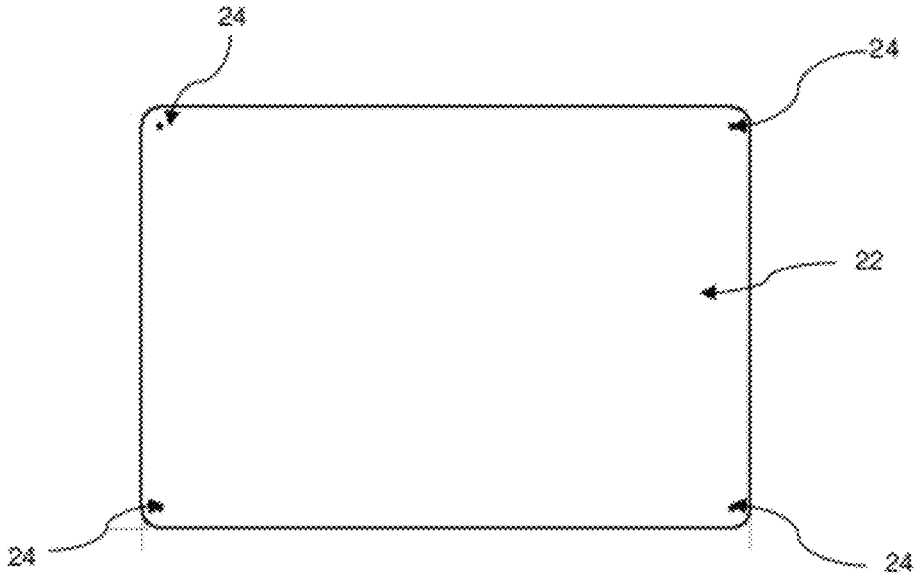
Figure 10:
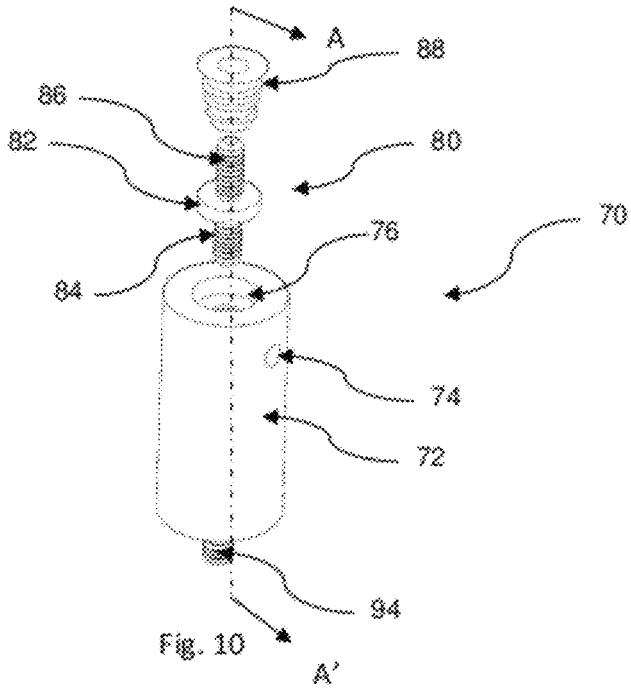
Figure 11:
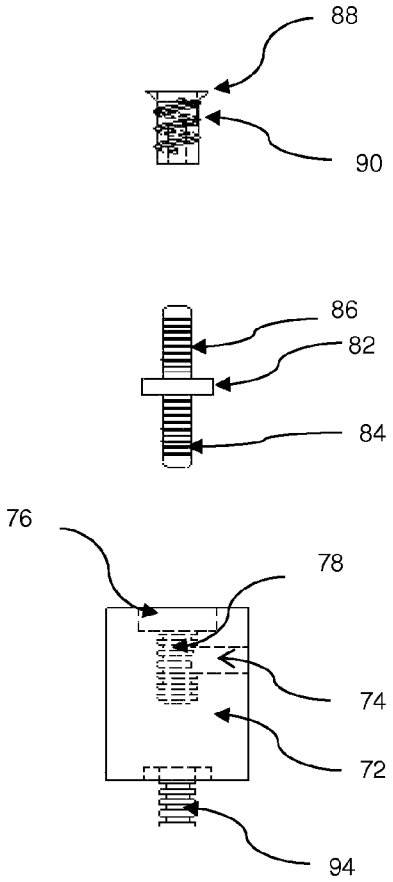
Figure 12:
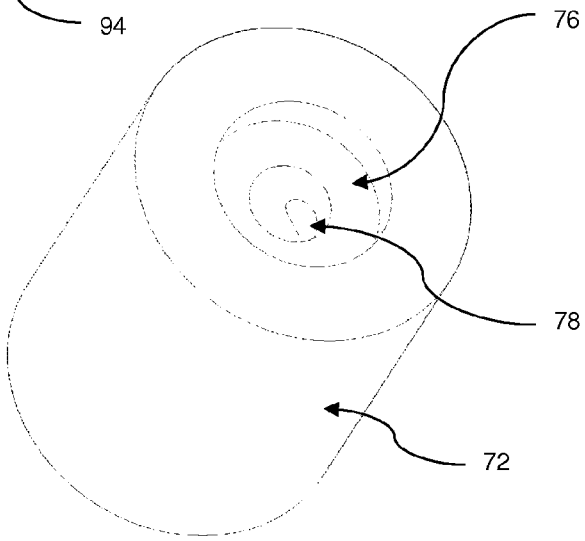
Figure 13:
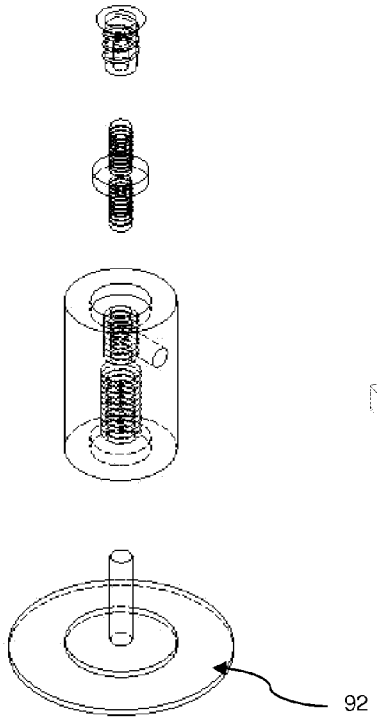
Figure 14:
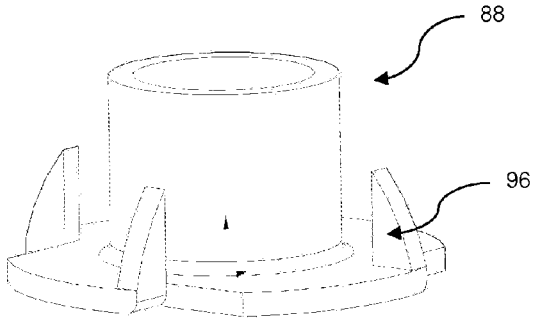
Figure 15:
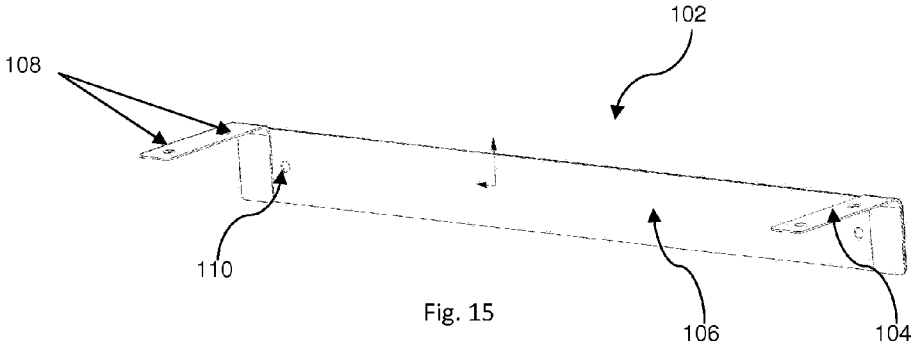
Figure 16:
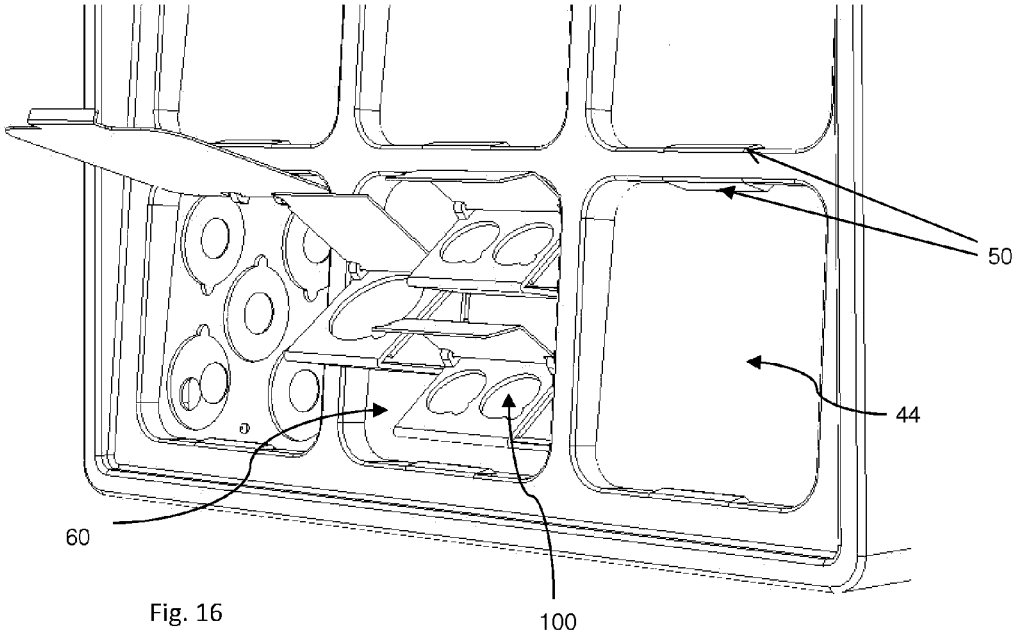
Figure 17:
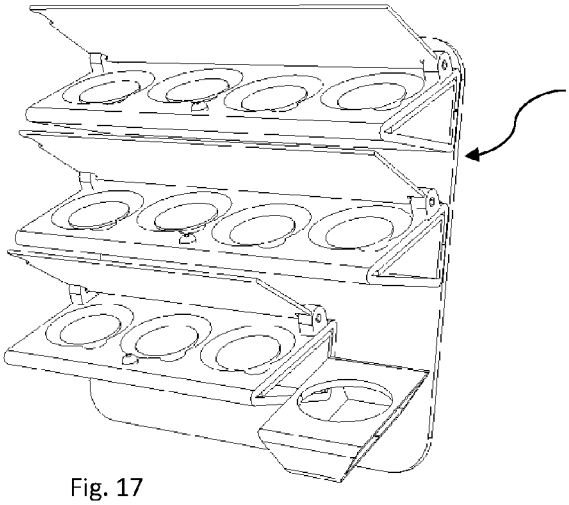
Figure 18:
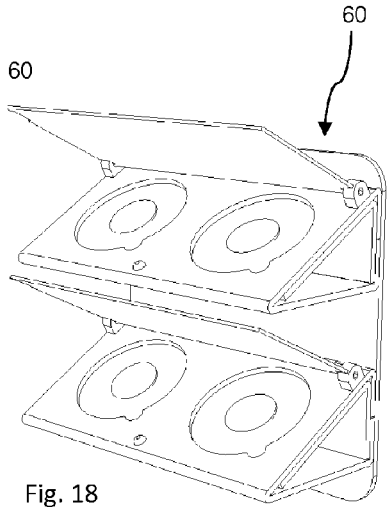
Figure 19:
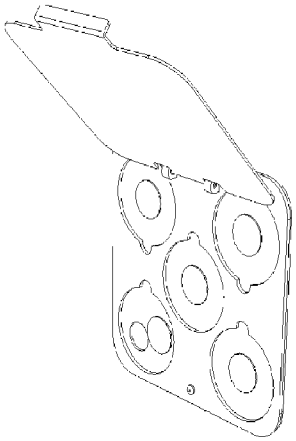
Figure 20:
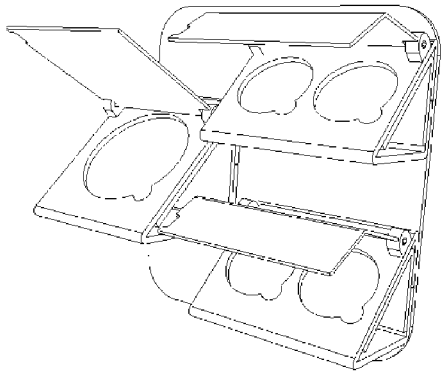
Figure 21:
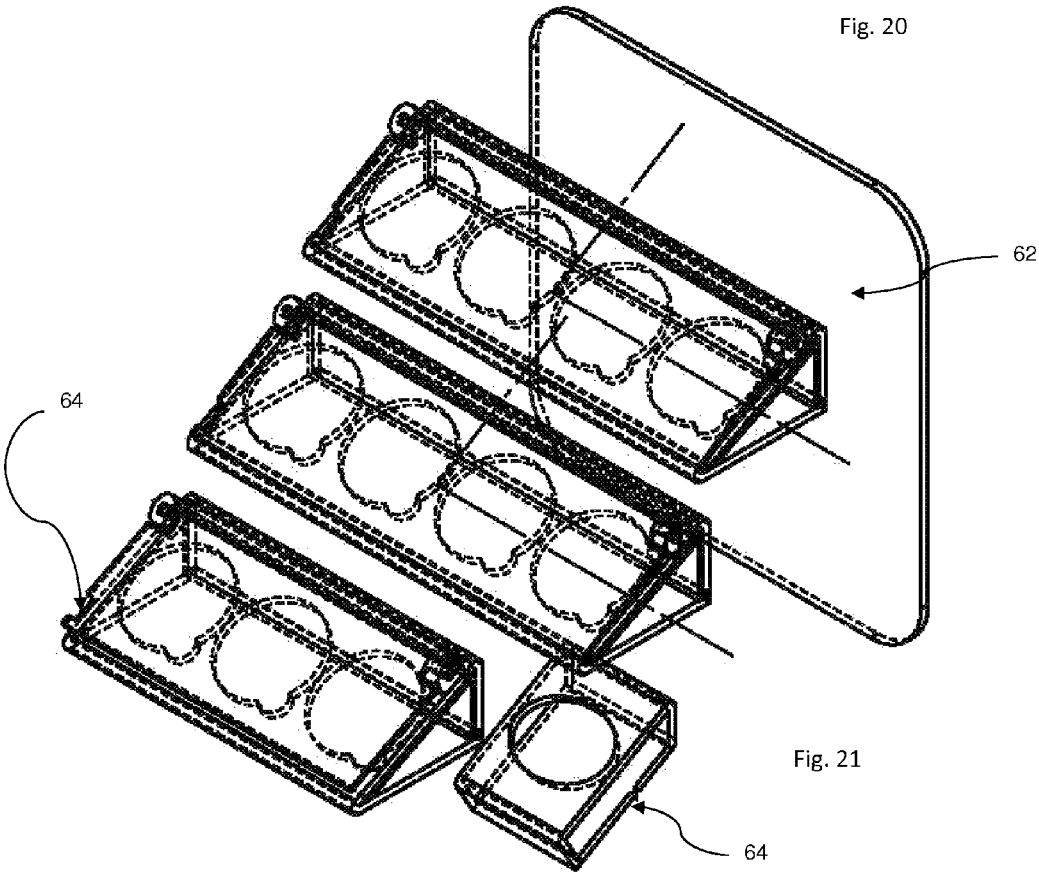
Figure 22:
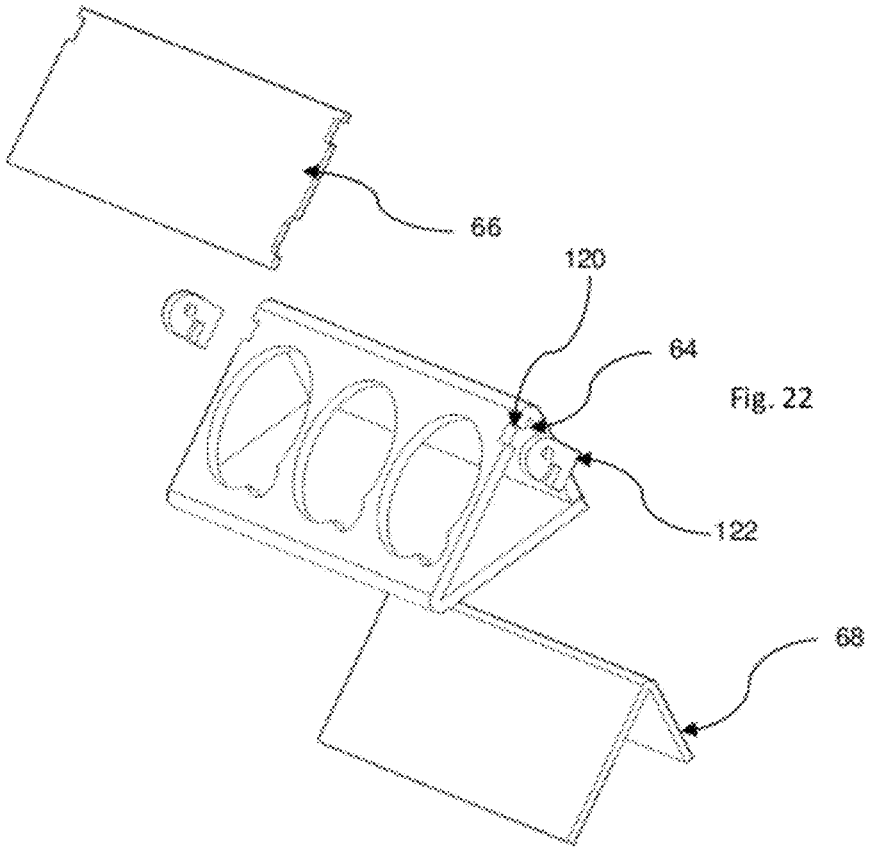
Figure 23:
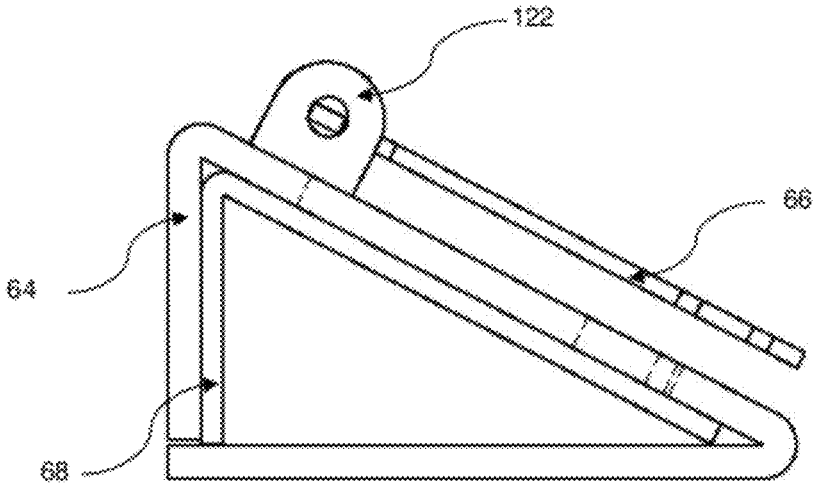
Figure 24:
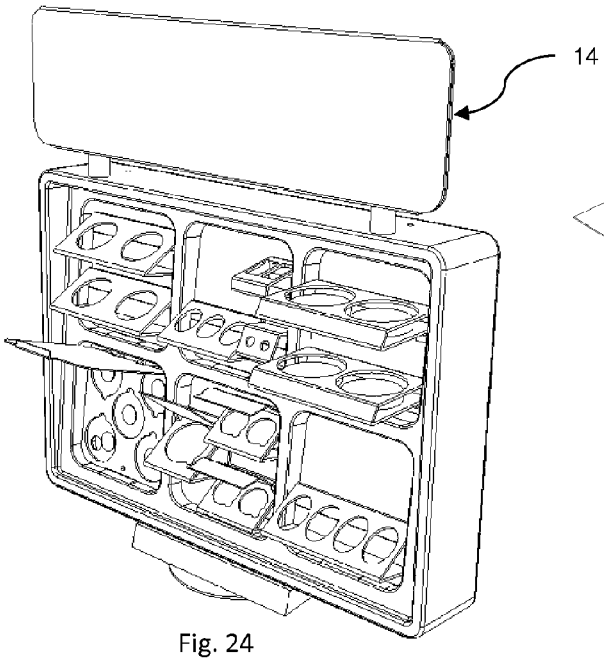
Figure 25:
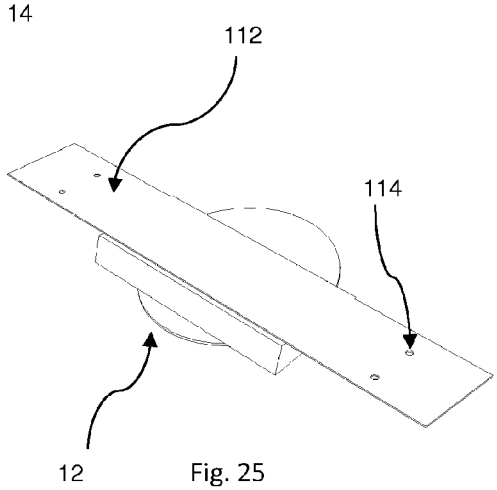
Figure 26:
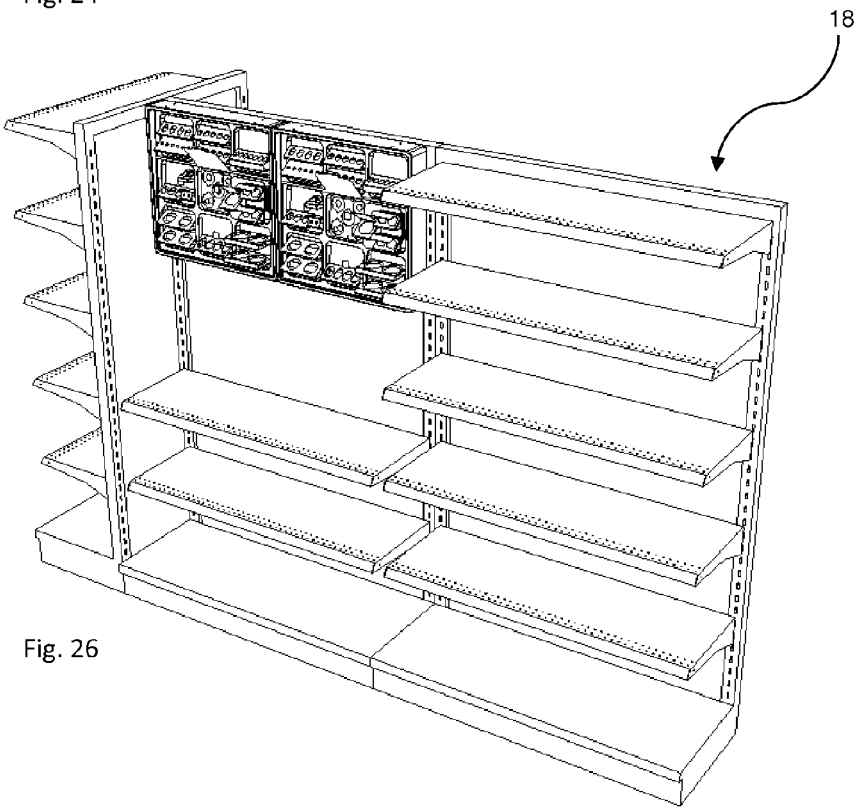
Figure 27:
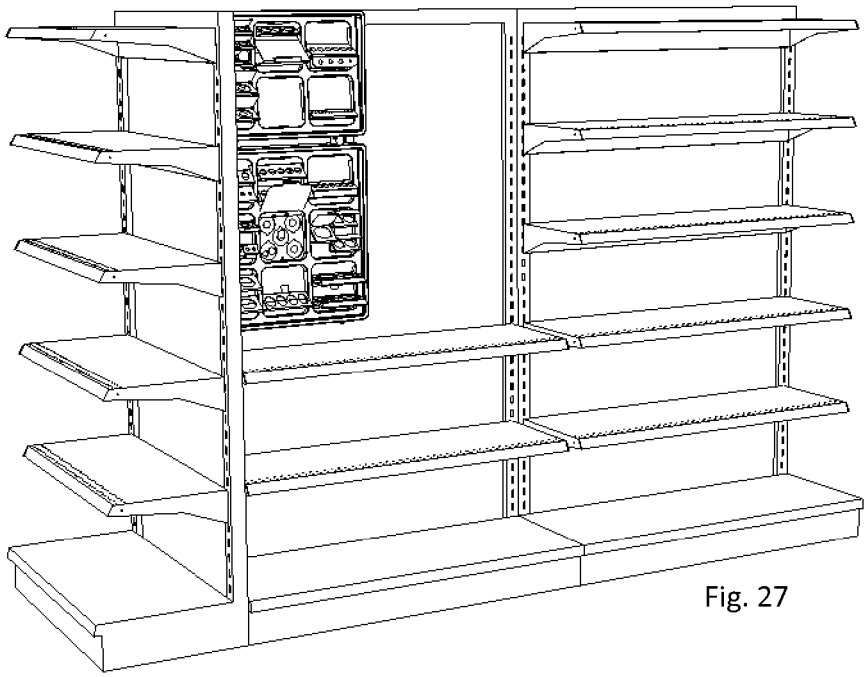
Figure 28:
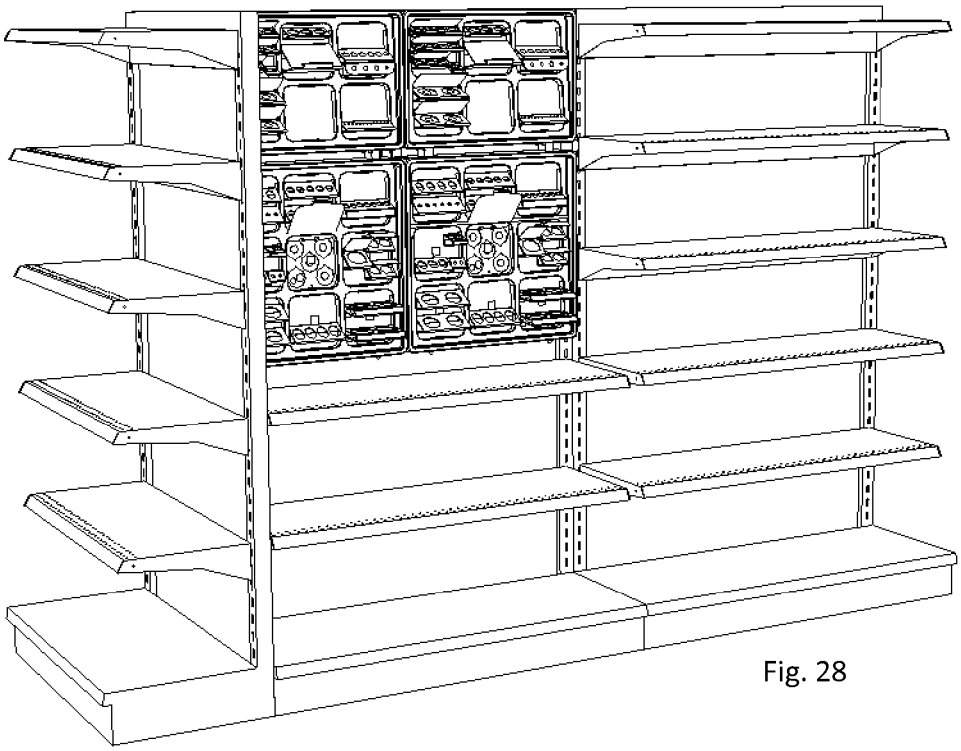
Figure 29:
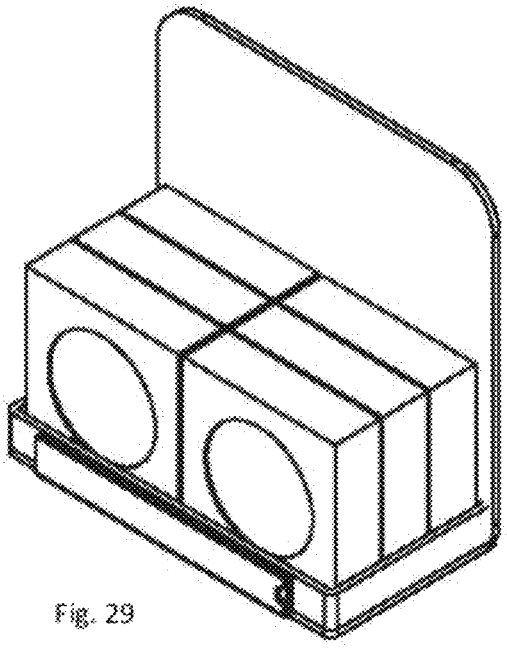
Figure 30:
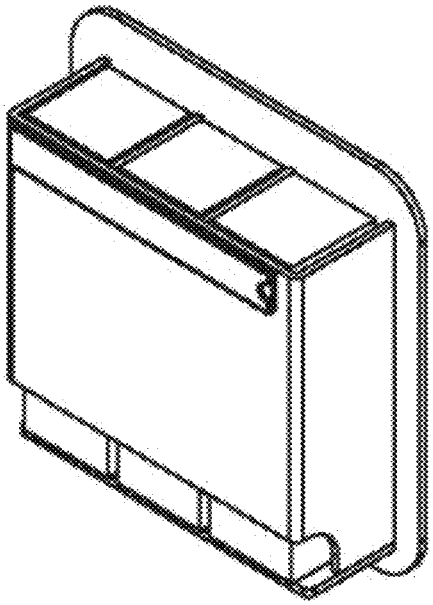
Figure 31:
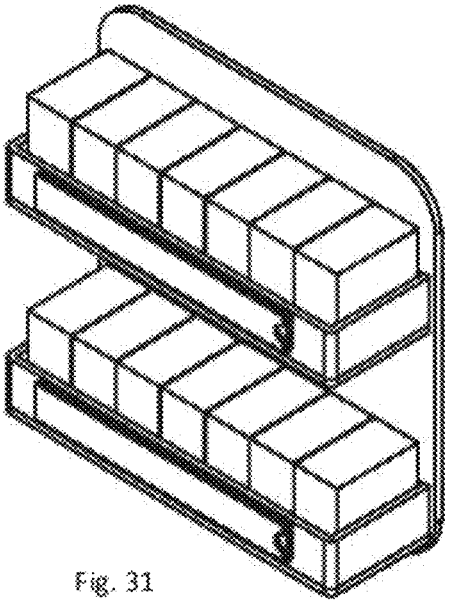
Figures 32, 32A:
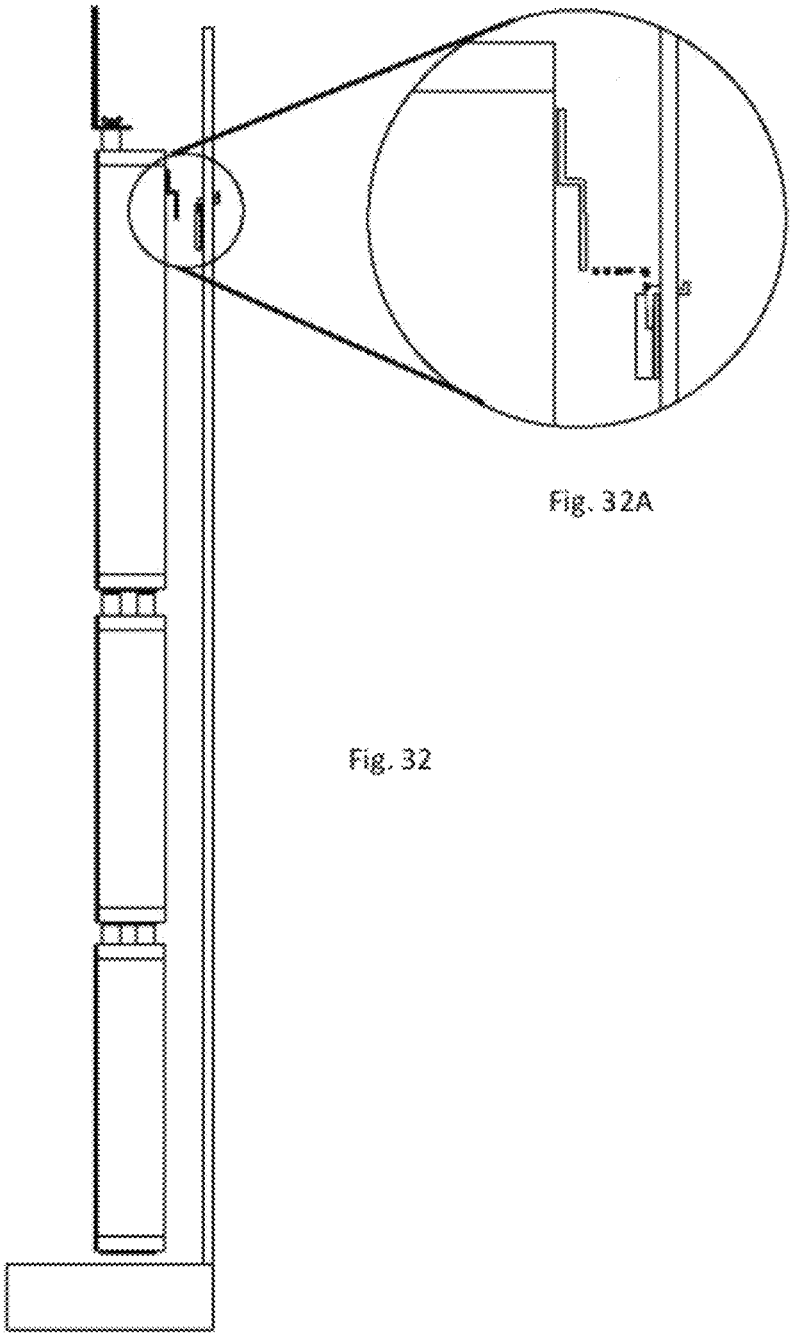
Figure 33:
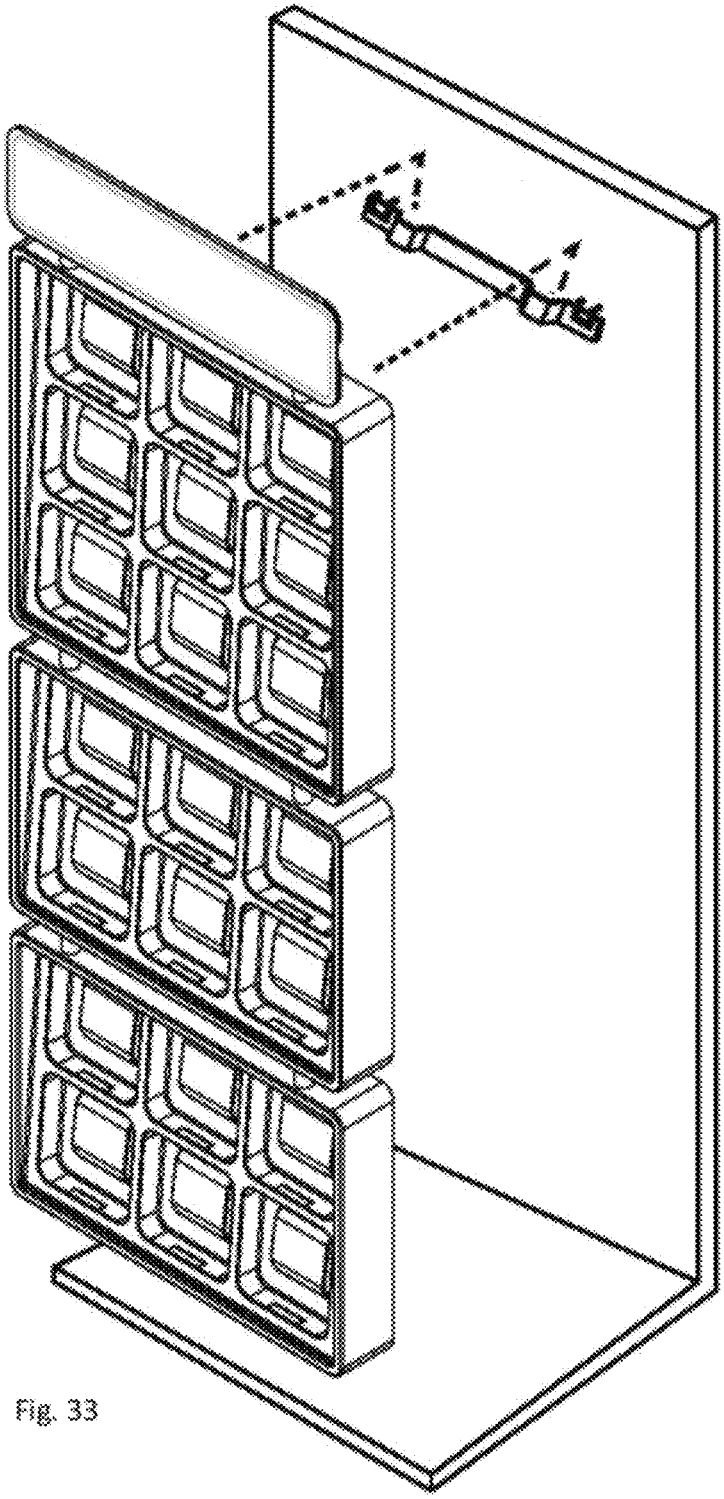

FIG. **6*a* is a cross section view of the section with the plurality of cavities along the length of the section labeled B-B in FIG. 6**;

FIG. 7 is a conventional view in perspective of the section with the plurality of cavities;

FIG. 8 is a lower view of the section with the plurality of cavities;

FIG. 9 is a front view of the lid;

FIG. 10 is a conventional view in perspective of the connector and of its related parts;

FIG. 11 is a cross sectional view of the connector and of its related parts along the length of the lines labeled A-A' in FIG. 10;

FIG. 12 is an upper view in conventional perspective of the connector;

FIG. 13 is a front view of a connector assembled unto a leveler and of the parts related to the connector, wherein the connector is in a phantom view;

FIG. 14 is a first embodiment of the insert;

FIG. 15 is a conventional view in perspective of the wall's support;

FIG. 16 is a detailed view of a module, specifically of a section with cavities and of an interchangeable mask which is hooked unto the section with cavities;

FIG. 17 is a view in conventional perspective of a first embodiment of the interchangeable mask;

FIG. 18 is a view in conventional perspective of a second embodiment of the interchangeable mask;

FIG. 19 is a view in conventional perspective of a third embodiment of the interchangeable mask;

FIG. 20 is a view in conventional perspective of a fourth embodiment of the interchangeable mask;

FIG. 21 is an exploded view in conventional perspective of an embodiment of the interchangeable mask;

FIG. 22 is a view in conventional perspective of one part of the interchangeable mask;

FIG. 23 is a lateral view of one part of the interchangeable mask;

FIG. 24 is a view in perspective of one part of one embodiment of the display piece of furniture with a swiveling base accessory for a counter;

FIG. 25 is a view in perspective with a swiveling base accessory to be changed into the embodiment of a counter;

FIG. 26 is a view in conventional perspective of the application of the complete system to a standard gondola in the market;

FIG. 27 is another view in conventional perspective of the display piece of furniture on a gondola;

FIG. 28 is a view in conventional perspective of the display piece of furniture in a second configuration on a gondola;

FIG. 29 is a view in conventional perspective of an embodiment of the interchangeable mask;

FIG. 30 is a view in conventional perspective of another embodiment of the interchangeable mask;

FIG. 31 is a view in conventional perspective of yet another embodiment of the interchangeable mask;

FIG. 32 is a lateral view of the self-supported display piece of furniture;

FIG. 32A is a detailed view of the self-supported display piece of furniture from FIG. 32; and FIG. 33 is a view in conventional perspective of the self-supported display piece of furniture wherein the piece of furniture is being hung on a gondola.

DETAILED DESCRIPTION OF THE INVENTION

The present invention makes known a system for a modular display, and more specifically, it makes known modular displays intended for products and particularly, versatile modular displays intended for points of sales for products in small packaging, modular displays which can be exchanged between self-supported shelving and gondolas.

Figure 1:
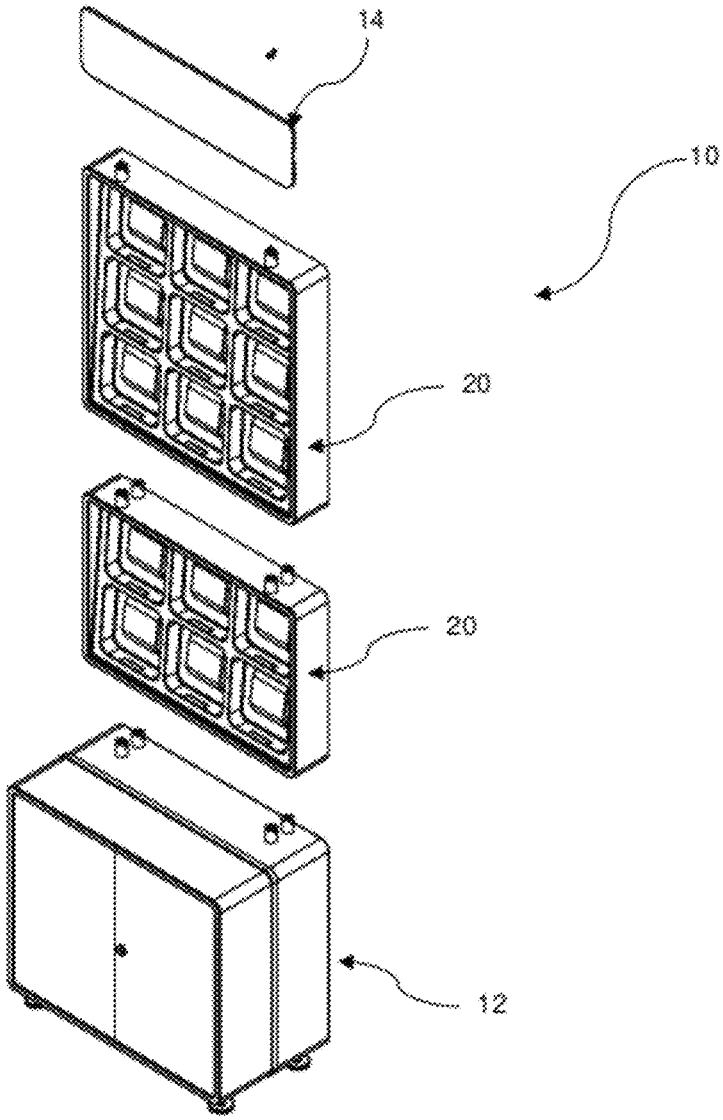
FIG. 1 is a partially exploded conventional view in perspective of a self-supporting display piece of furniture of the present invention.

FIGS. 1 thru 23 of the present invention refer to the general system of the modular display of the present invention. In FIG. 1 an exploded view of a modular system 1 with self-supported display can be seen. In the system shown in FIG. 1, two compound modules 20 are shown, which shall be described in greater detail in the following lines. It should be highlighted that the number of compound modules can vary in the modular system 10, depending on the space available, so that the modular system 10 must comprise at least one compound module 20. If the modular display system 10 needs to be self-supported, a base 12 must be provided; if the modular display system 10 is going to be placed on a gondola, the base 12 is optional. Such as will be shown in the following, the mounting and un-mounting of the base 12 is easy and fast enough to grant the modular system enough versatility. Additionally, a crest 14 can be provided, to be able to advertise the product being displayed in the modular system 10. Such as is shown in FIG. 1, the compound modules 20 can be formed by a plurality of cavities, and specifically, such as is shown in the figure, the number of cavities can vary, that is, at least one cavity is required in the compound module 20. The compound modules 20, the base 12 and the crest 14 are interconnected amongst themselves by means of connectors 70, which shall be explained in more detail as follows.

Figure 2:
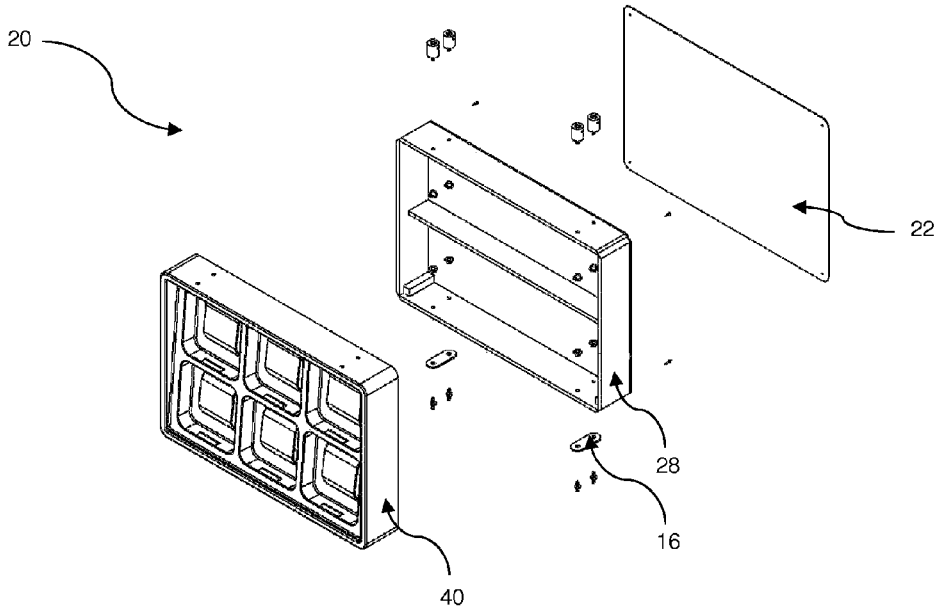
FIG. 2 is an exploded conventional view in perspective of a compound module of a lid, of a frame and of a section with a plurality of cavities.
Figure 3:
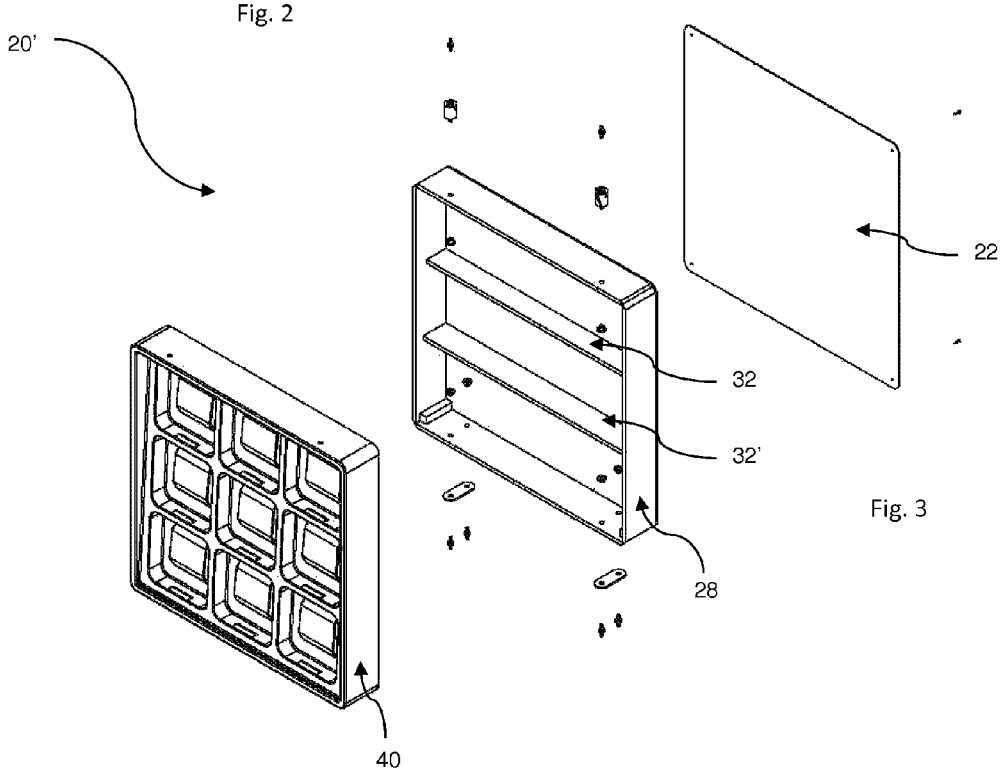
FIG. 3 is an exploded conventional view in perspective of the second module composed of the same components.

The following description shall be made referencing FIGS. 2 thru 9. Such as are seen in FIGS. 2 and 3, the compound modules 20, even though they vary in the number of cavities, are essentially formed by the same parts. The compound modules 20 in a general manner are comprised of a lid 22, a frame 28 and a section with a plurality of cavities 40. The lid 22 and the section with the cavities 40 can be thermoformed. The lid 22, the frame 28 and the section with cavities 40 are assembled among themselves to form the compound module 20.

The lid 22 is the back section of the compound module and has a surface which is generally smooth and uniform on its front and back face. The lid 22 preferably consists of at least one means to provide connection, such as can be an orifice 24 in close proximity to every corner present on the lid 22. The orifice 24 will ease the connection between the lid 22, the frame 28 and the section with cavities 40.

Figure 4:
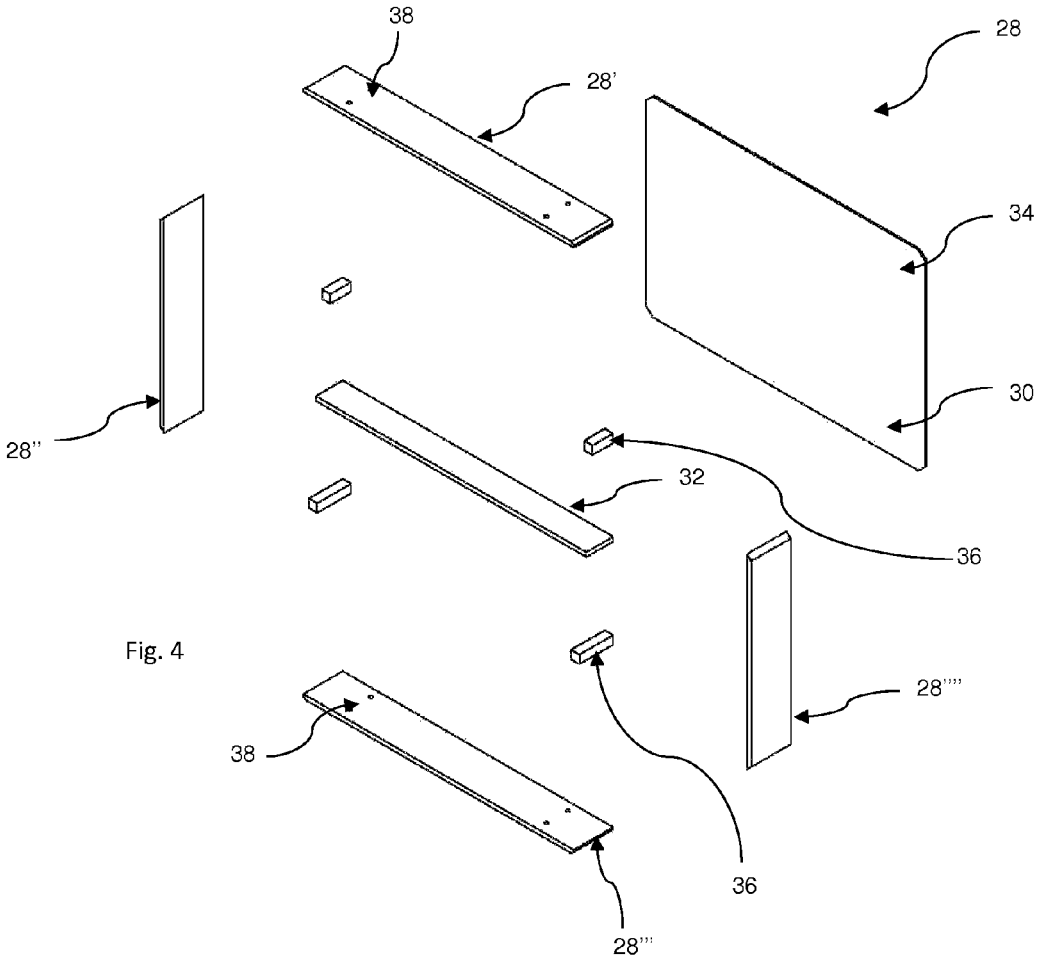
FIG. 4 is an exploded conventional view in perspective of a frame.
Figure 5:
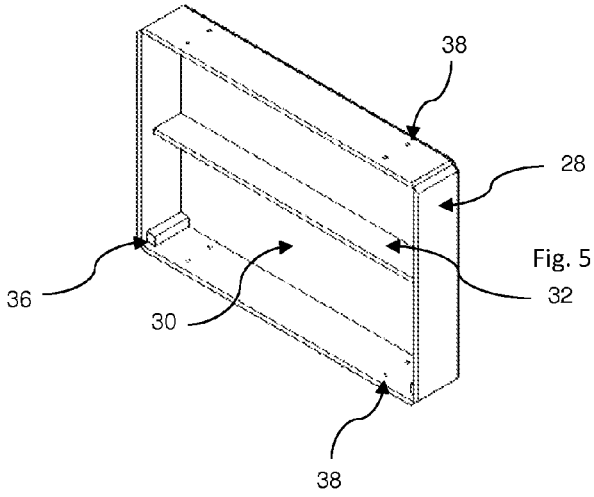
FIG. 5 is a front conventional view in perspective of a frame.

The frame 28 is formed by different sides 28' thru 28'''', wherein the outer shape or silhouette of the frame 28 formed by its sides 28' thru 28'''', is essentially similar to the shape or silhouette of the lid 22. The frame 28 is additionally composed of a lid 30, closing the back part of the frame 28. The side opposite the lid, that is, the front part of the frame 28 is found open. The inner part of the frame 28 is substantially hollow. Depending on the number of lines of cavities which are formed in the section with the plurality of cavities 40, shelves are provided 32, 32', same which run from a first vertical side 32'' towards an opposite second vertical side 32'''', in a substantially horizontal manner, preferably without inclination to be able to be correctly coupled to the corresponding section with the plurality of cavities 40. A shelf 32, 32' is provided between each line of cavities. As an option, a vertical shelf (not shown) can be provided per each column of cavities which are formed on the section with the plurality of cavities 40, wherein the vertical shelves (not shown) run from a first horizontal side 32' towards an opposite horizontal side 32''', in a substantially vertical manner to be able to be correctly coupled to the corresponding section with the plurality of cavities 40. A vertical shelf (not shown) can be provided between each column of cavities. The shelves have a length similar to and subtly lesser than the distance between the opposite sides of the frame 28. For example the distance of the shelves 32 and 32' is slightly lesser than the distance of the sides 28'' and 28'''', in such a way, that the shelves 32, 32' can be coupled to the frame 28 between the sides 28'', 28''''. Additionally, the shelves 32 have a width lesser than the width of the sides 28' thru 28'''' of the frame 28 in such a way that the sides of the frame 28 overhang in relation to the shelves 32. The height of the shelves must be lesser than the height provided in the corresponding part of the section with the plurality of cavities 40. On the corners formed between each one of the sides 28' thru 28'''' of the frame, a reinforcement 36 is provided. The reinforcement 36 ensures that the assembly between the frame 28 and the section with the plurality of cavities 40 is fastened in such a way that allows for no movement between these two parts. On the lid 30 of the frame, an orifice 34 is provided in close proximity to each corner of said lid 30, an orifice 34 which, when the lid 30 of the frame and the lid 22 of the compound module are united, it is collinear to the orifice 24 of the lid 22. In this way, a means of connection, such as can be a threaded means, selected amongst for example a screw or fastener, secures the lid 22 and the frame 28. Additionally, on the sides 28' and 28''', at least one orifice 38 is provided in close proximity to each corner of the side. As is shown in FIGS. 4 and 5, at least two orifices 38 can be provided in close proximity to each corner.

On the other hand, in FIGS. 6 thru 9 the section with cavities 40 can be seen. The section with cavities 40 has a plurality of cavities 42, at least one, preferably two, and even more preferably from four to sixteen cavities, however, it can have more than sixteen cavities, depending on the specific need of the modular display system 10. The cavities 42 can have different shapes; however, the preferred cavities 42 are those in quadrangles, or any kind of shape which has at least one straight side such as can be a triangle or a polygon. The interchangeable mask 60 will have the same shape as the shape of the cavity 42. Each cavity 42 in the section with cavities is formed by a raised flat surface 44, on which is seated the interchangeable mask 60 which contains the products to be displayed 100. Surrounding the raised flat surface 44 a groove 46 is formed, wherein the groove 46 is formed by the walls of the raised flat surface 44 and the front wall 48 of the section with cavities. On the substantially horizontal wall formed between the grove 46 and the front wall 48 of the section with cavities, specifically on the upper wall and on the lower wall, a notch 50 is formed in a substantially central part of the walls formed between the groove 46 and the front wall 48, and more preferably a notch 50 per each one of the corners formed by the front wall 48 and the groove 46, wherein each one of the notches is in close proximity to said corners. The notches 50 are capable of receiving, fastening and lodging the interchangeable mask 60 in a determined position until the interchangeable mask 60 needs to be exchanged. The inner part 52 of the section with cavities 40 is gradually narrowed, in such a way that the width of the upper inner part 52 is greater and the width of the lower part of the inner part 52 of the section with cavities is lesser. The border of the section with cavities is substantially hollow in the back part. That is, the space formed between the side 56 of the border of the section with cavities and the first substantially horizontal wall formed between the groove 46 and the front wall 48, is substantially hollow in its back part, so that in the back part of the section with cavities 40 a groove is formed between the border 56 and the substantially horizontal wall formed between the groove 46 and the front wall 48. By means of this groove formed in the back part of the section with cavities 40, the section with cavities 40 is capable of embracing the frame 28. The lack of movement is ensured between the section with cavities 40 and the frame 28 by means of the reinforcements 36 provided on the frame 28. As was previously mentioned, the interchangeable mask 60, by means of the notch 50 is capable of being received and fastened unto said cavity 42. It is especially preferred that the sections with the plurality of cavities 40 be made of styrene or a derivative of the same, to be able to take advantage of the elastic memory of said plastic and to allow for the exchanging of the interchangeable masks 60. The cavity's raised flat surface 44 creates outward pressure unto the interchangeable mask 60, in such a way that the interchangeable mask 60 is hinged according to the modular display system 10. The interchangeable mask 60 shall be described in greater detail in the following lines. On the upper and lower parts of the frame of the section with cavities 40, some openings 58 are provided from which, once the section with cavities 40 is mounted unto the frame 28, they are collinear to the openings 38 on the sides 28', 28' of the frame.

The following description is made in conjunction with FIGS. 10 thru 14. At least two connectors 70 are assembled unto the compound module 20, wherein the connectors 70 allow for the connection between: the compound module 20 and a base 12; a first compound module 20 and a second compound module 20'; or even the compound module 20 and a crest 14. The main body of the connector 72 is shown as a substantially cylindrical shape in FIGS. 10 thru 13, however, the main body 72 can have substantially any tri-dimensional shape, such as could be a hexahedron. The lateral main body 72 of the connector is substantially solid and uniform and consists of at least one opening 74 in a substantially upper part of said main body. On the upper surface of the connector's main body 72 in a substantially central portion of said main body 72, a groove 76 with an opening 78 is provided, which is collinear to the groove 76. The opposite side of said main body 72, that is, the lower side, can be provided with a groove 76 and an opening 78. The opening 78 on the groove of the upper surface is connected with the opening 74 of the main body. In turn, the connectors 70 comprise at least one threaded cylinder 80, wherein the threaded cylinder 80 has an intermediate 82 which is not threaded, causing the cylinder 80 to have a first section 84 and a second section 86, wherein the first section 86 is inserted into the main body 72 of the connector, specifically through the opening 78 in the groove 76 on the upper surface of the main body. The intermediate rests on the groove 76. When the intermediate 82 rests on the groove 76, the intermediate 82 and the upper surface of the main body 72 form a uniform surface, while the second section 86 overhangs according to the main body 72, on which over the second section 86 an insert 88 rests.

Regarding FIGS. 10 thru 14, and especially in so far as regarding FIGS. 11, 13 and 14, the insert 88 can have substantially any shape, in the case of FIGS. 11 and 13, an insert in the shape of a truncated cone is provided. The insert 88 of FIGS. 11 and 13 is gradually narrowed, in such a way that at least one part of the insert 88 rests over the intermediate 82, this being of a similar width to the width of the intermediate 82 and another part of the insert 88 which is wider than the groove 76, wherein the insert in its entirety covers, at least partially, the second section 86 of the threaded cylinder. The insert 88 has an inner threaded cord, so that it threads with the second section 86 until bumping into the intermediate 82. The insert 88 can have, along the length of its outer body, flanges 90 for better fastening between the parts being secured amongst them. Alternatively, the insert 88 can have flaps 96 with the same objective. By means of the opening 74, a threaded means or connection is provided, such as can be a screw, a press clip or a fastener (not shown). The threaded means is capable of penetrating through the opening 74 and colliding with the first section 84 of the threaded cylinder, thus fastening the threaded cylinder 80. If an opening 74 is provided set on the lower surface of the main body 72, this opening allows for the connection of a threaded means of connection to a leveler 92, same which is capable of leveling the base 12 wherein the modular system 10 shall be mounted unto or to a second threaded cylinder 94.

Regarding FIG. 15, on the back part of the compound system 20, a built-in support 102 can be provided. The built-in support 102 is essentially composed of two parts 104, 106, the first part 104 is substantially perpendicular to the second piece 106, wherein the first piece 104 is on a substantially horizontal plane and the second piece 106 is on a substantially vertical plane. The first piece 104 has at least one orifice 108, preferably at least at least a couple of orifices. The first piece 104 is set in such a way to be mounted on the upper walls of both the frame 28 and the outer upper part 54 of the section with cavities. The orifices 108, once the first piece 104 rests on the upper walls of the frame 28 and the outer part, are collinear to the orifices 58 and 38. On the other hand, the second piece has at least one orifice 110. The second piece is set in such a way that, when the first piece is resting on the upper walls, the second piece 106 adjoins with the lid 22. In this way, the orifice 110, once the second piece 106 adjoins to the lid 22, it is collinear to the orifices 24 and 34.

To connect a compound module 20 to a second compound module 20' such as is shown in FIG. 1, the threaded cylinder 94 of the connector crosses the collinear orifices 58, 38 and 108 of the section with cavities, of the frame and of the built-in support, respectively, and an insert is threaded into said threaded cylinder 94. The insert 88 is secured unto the intermediate 82, thus securing the connector 70 to the first compound module 20. On the other hand, when the second compound module rests over the connector 70, specifically resting in such a way that the second section 86 crosses the collinear orifices in the lower section of the section with cavities and of the frame, respectively, an insert 88 is threaded to said second section 86. In this way, the connection between a first compound module 20 and a second compound module 20' is secured.

Between the second compound module 20' and the second connection 86 at least one pair of reinforcements 16 is placed, same which are assembled unto the module by means of the orifices on said reinforcements, reinforcement orifices which are collinear to the orifices 58, 38 and 108 of the section with cavities of the frame and the built-in support respectively. Alternatively, the reinforcements 16 can be ignored if the compound module 20 is directly connected to the base 12, and if the base 12 has a connection module, such as will be shown in an embodiment of the invention.

Regarding FIGS. 16 thru 23, the interchangeable mask 60 is composed of different parts. Specifically, the interchangeable mask 60 is composed of a back wall 62, such as can be a mirror, a brace holder 64 for placement of products 100 to be displayed and a lid 66. The back wall 62 is fastened, in at least two of its borders, by means of the notches 50 in the cavities 42 thus fastening the interchangeable mask 60 and thereby the products 100 to be displayed. At least one brace holder 64 must be present on the interchangeable mask 60 such as is shown in FIG. 19. However, a plurality of brace holders 64 can be present on the interchangeable mask, such as is shown in FIGS. 18-18 and 20-21. The brace holders 64 can be, totally plane or have a triangular shape when seen from the side, that is, a pentahedron, especially a triangular prism. These two shapes are easily coupled to a large majority of the products being displayed and allows for easy access to the products to be able to grab the same. Depending on the products 100 being displayed, orifices along the length of the brace holder 64 can be provided to insert into said orifices of the brace holder the products 100 to be displayed. If the product 100 being displayed does not have a significant depth, such as could be a cosmetic powder container, a base 68 is provided inside of the brace holder 64 forming a type of groove or even an elastic means (not shown) which pushes the product in an upward direction. A notch 120 over the brace holder supports a hinge 122. The hinge 122 in turn allows the opening and the closing of the lid 66 for access to the product 100. The brace holders 64 are fastened to the back wall by means of glue.

To be able to hang the compound module 20 unto a gondola 18, a means of connection (not shown), same which is found fixed to the gondola 18, crosses the orifices 24, 34, 110, of the lid, the frame and the built-in support respectively, thus fastening the compound module 20 to the gondola 18, such as is shown in FIGS. 26 thru 28. It is preferable that this fastening be found present at least one time per column of the compound modules, wherein the fastening unto the gondola is preferred to be on the upper compound module 20 of the column of compound modules.

Such as was previously mentioned, the reinforcements 16 can be ignored if the compound module 20 is directly connected to the base 12, and if the base 12 has a means of connection, such as is shown in FIGS. 24 and 25. Specifically, the base is shown with a connection module 112, in which the connection module 112 has orifices 114 which, when the compound module 20 rests on the base 12, they are collinear with the orifices 38 and 58 of the frame and the section with the plurality of cavities respectively.

Alterations of the structure previously described through the present, shall be able to be foreseen by those with expertise in the field. However, it must be understood, that the present description is related with the preferred embodiments of the invention, which are solely for illustrative purposes, and must not be construed as a limitation of the invention. All modifications which do not depart from the spirit of the invention are included within the body of the attached claims.

What is claimed is:

1. A versatile display module comprising:

at least one compound module comprising a back lid;

a frame having a back side assembled to the back lid, the frame comprising an upper side, a lower side, lateral sides and a lid, wherein the upper and lower sides have at least one orifice; and a section with at least one cavity, a front wall, an upper side, a lower side and a back face, the cavity comprising a raised flat surface, a groove surrounding and raised flat surface, and having a cavity side, upper and lower walls which are substantially perpendicular to said groove, the front wall being bound by the at least one cavity and by said cavity side wall which is substantially perpendicular to said front wall, the back face being substantially hollow so that said frame is assembled to the back face of said section, wherein the upper and lower side of the section has at least one orifice collinear to the at least one orifice of the lower and upper sides of the frame, the collinear orifices allowing the assembly of a connector, and wherein in at least one of the cavity upper or lower walls, a notch is formed; and at least one interchangeable mask fastened to the section by means of at least one notch and said raised flat surface, the interchangeable mask comprising a back wall and at least one brace holder capable of supporting goods to be displayed, wherein the brace holder is fastened to the back wall of the interchangeable mask.

2. The versatile modular display according to claim 1, wherein the lateral sides of the frame are a first lateral side and a second lateral side and wherein the frame additionally comprises at least one shelf which runs in a substantially horizontal manner from the first lateral side to the second lateral side of the frame, and at least one reinforcement per shelf.

3. The versatile modular display according to claim 1, wherein the upper and lower sides of the frame have at least two orifices, wherein the lateral sides of the frame comprise a first and second lateral extreme, each one of the orifices of the upper and lower sides of the frame being in close proximity to the first and second lateral extreme of said sides of the frame respective and wherein the upper and lower sides of the section have at least two orifices, each one of the orifices of the upper and lower side of the section being in close proximity to a first and second lateral extreme of said side walls of the section.

4. The versatile modular display according to claim 1, wherein the versatile modular display comprises a built-in support, wherein the built-in support comprises a first piece which is substantially horizontal and a second piece substantially perpendicular to the first piece, wherein the first piece comprises at least one orifice substantially collinear with the at least one orifice of the upper and lower sides of the frame and of the section and wherein the second piece contains at least one orifice substantially collinear with the at least one orifice of the back lid and the lid of the frame.

5. The versatile modular display according to claim 1, wherein a reinforcement is placed on a corner of the frame, and wherein the reinforcement is coupled to the back face of the section.

6. The versatile modular display according to claim 1, wherein the at least one interchangeable mask comprises a base to serve as brace holder, a hinge on an upper surface of said brace holder and a lid connected to said hinge, to protect the goods being displayed.

7. The versatile display module according to claim 1, wherein the front wall is tapered, so that a first end of the front wall is proximate to the back lid and a second end of the front wall is distant to the back lid.

8. The versatile modular display according to claim 1, wherein the display additionally comprises:

at least one connector per each compound module, the connector assembled onto the orifices on the lower and upper sides of said section and of said frame, wherein the connector comprises a main body with a lower surface, an upper surface and at least one lateral surface, the upper surface has an opening through which a first connecting means is inserted, the connector additionally comprises an insert which surrounds, at least partly, the first connecting means, the at least one lateral surface has an opening in connection with the opening of the upper surface, and wherein a second connecting means is inserted through the opening of said lateral surface to fasten the first connecting means.

9. The versatile modular display according to claim 8, wherein the opening of the at least one lateral surface of the connector is found in a substantially upper part of the said at least one lateral surface.

10. The versatile modular display according to claim 8, wherein the first connecting means of the connector is a threaded cylinder which has an intermediate section, a first section and a second threaded section, the upper surface of the connector has a groove in which the opening is found, the opening of the upper surface being a threaded opening and being collinear to said groove, wherein the first section is threaded in the threaded orifice of the upper surface of the connector and the intermediate section rests over the groove, the second section overhangs according to the main body of the connector and wherein the insert surrounds, at least partly, the second threaded section.

11. The versatile modular display according to claim 10, wherein between the first section of the threaded cylinder and the insert, a reinforcement is placed, and wherein between the reinforcement and the insert, the upper or lower side of the frame or of the section is found.

12. The versatile modular display according to claim 10, wherein between the upper surface of the connector and the insert, the upper or lower side of the frame and of the section are found.

13. The versatile modular display according to claim 8, wherein the versatile modular display comprises a second connector, wherein the second connector connects a first compound module to a base, wherein the base additionally comprises a third connector, and wherein the lower surface of the third connector comprises a threaded orifice through which a leveler is threaded.

14. The versatile modular display according to claim 8, wherein the insert comprises a plurality of flanges or flaps on its outer surface.

15. The versatile display module of claim 1, wherein the back lid has at least one orifice and the lid of the frame has at least one orifice, wherein the at least one orifice of the back lid is collinear with the at least one orifice of the frame when the frame is assembled to the back lid, and wherein the back lid is fastened to the lid of the frame by means of the at least one orifice of the back lid and the at least one orifice of the lid of the frame.

16. The versatile modular display according to claim 15, wherein the at least one orifice of the back lid are two orifices, each orifice in close proximity to a corner of said back lid and wherein the at least one orifice of the frame lid is at least an orifice in close proximity to a corner of said lid of the frame.

17. A versatile display module comprising:

at least one compound module comprising a back lid;

a frame assembled to the back lid, the frame comprising an upper side, a lower side, lateral sides and a lid, wherein the upper and lower sides have at least one orifice;

a section with at least one cavity, a front wall, an upper side, a lower side and a back face, the cavity comprising a raised flat surface, a groove surrounding said raised flat surface, and having a cavity side, upper and lower walls which are substantially perpendicular to said groove, the front wall being bound by the at least one cavity and by said cavity side wall which is substantially perpendicular to said front wall, the back face being substantially hollow so that said frame is assembled to the back face of said section, wherein the upper and lower side of the section has at least one orifice collinear to the at least one orifice of the lower and upper sides of the frame, the collinear orifices allowing the assembly of a connector, and wherein in at least one of the cavity upper or lower walls, a notch is formed;

at least one interchangeable mask fastened to the section by means of the at least one notch and said raised flat surface, the interchangeable mask comprising a back wall and at least one brace holder capable of supporting goods to be displayed, wherein the brace holder is fastened to the back wall of the interchangeable mask; and at least one connector per each compound module, the connector assembled unto the collinear orifices on the lower and upper sides of said section and of said frame, wherein the connector comprises a main body with a lower surface, an upper surface and at least one lateral surface, the upper surface has an opening through which a first connecting means is inserted, the connector additionally comprises an insert which surrounds, at least partly, the first connecting means, the at least one lateral surface has an opening in connection with the opening of the upper surface, and wherein a second connecting means is inserted through the opening of said lateral surface to fasten the first connecting means.

18. A versatile display module comprising:

at least one compound module comprising a back lid;

a frame assembled to the back lid, the frame comprising an upper side, a lower side, lateral sides and a lid, wherein the upper and lower sides have at least one orifice; and a section with at least one cavity, a front wall, an upper side, a lower side and a back face, the cavity comprising a raised flat surface, a groove surrounding said raised flat surface, and having a cavity side, upper and lower walls which are perpendicular to said groove, the front wall being bound by the at least one cavity and by said cavity side wall which is substantially perpendicular to said front wall, the back face being substantially hollow so that said frame is assembly to the back face of said section, wherein the upper and lower side of the section has at least one orifice collinear to the at least one orifice of the lower and upper sides of the frame, the collinear orifices allowing the assembly of a connector, and wherein in at least one of the cavity upper or lower walls, a notch is formed; and at least one interchangeable mask fastened to the section by means of the at least one notch and said raised flat surface, the interchangeable mask comprising a mirror and at least one brace holder capable of supporting goods to be displayed, wherein the brace holder is fastened to the mirror of the interchangeable mask;

wherein the front wall is tapered so that a first part of the front wall is proximate to the back lid and a second part of the front is distant to the back lid.

* * * * *